United States Patent [19]

Schachter

[11] 4,100,779

[45] Jul. 18, 1978

[54] KEY CHAIN RETAINER

[76] Inventor: Joseph D. Schachter, 866 Elm St., Manitoba, Canada

[21] Appl. No.: 784,151

[22] Filed: Apr. 4, 1977

[30] Foreign Application Priority Data

Feb. 28, 1977 [CA] Canada ..... 272840

[51] Int. Cl.[2] ..... A44B 15/00

[52] U.S. Cl. ..... 70/456 R

[58] Field of Search ..... 70/456 R, 457, 458, 70/459; 24/3 K; 150/40; 267/181

[56] References Cited

U.S. PATENT DOCUMENTS 2,694,844 11/1954 Grumbach ..... 70/459

FOREIGN PATENT DOCUMENTS 913,494 12/1962 United Kingdom ..... 70/458

OTHER PUBLICATIONS

Popular Science, Jun. 1961, Keys that Float, p. 135.

Popular Mechanics, Jul. 1953, Keys Carried Safely in Rowboat when Tied to Fishing Bobber, p. 160.

*Primary Examiner*—Robert L. Wolfe

*Attorney, Agent, or Firm*—Charles A. Laff; J. Warren Whitesel; Howard B. Rockman

[57] ABSTRACT

A key retainer having a structure such as to substantially reduce the risk of loss by bouncing out of a pocket. A block of compressible foam such as polyurethane foam has a key chain attached. By compressing the block of foam with the hand and inserting it into the pocket, the foam resiliently expands, substantially filling the pocket or otherwise exerting pressure against the material of the pocket. These forces as well as the accompanying friction forces hold the key retainer securely and safely in the pocket, even in the presence of bouncing or inverting the pocket.

7 Claims, 5 Drawing Figures

KEY CHAIN RETAINER

This invention relates to a key retainer which has structure so as to substantially reduce the possibility of loss.

Key retainers normally consist of a ring, clip or hook, or a ring or clip held on a chain which is attached to a novelty item such as a plastic or other visual identifier. Key hooks are also often fastened inside folding wallets, which are used to enclose multiplicity of keys for the purposes of presenting a more pleasing appearance, the retention of keys from being pulled off the hooks, and to keep the metallic sharp edges of the key from chafing the material of a pocket or purse.

Such key retainers normally are made so as to take up as little space as possible, in order that space should remain in pocket or purse for other items. Because of this, there has been a serious problem observed with their use in certain environments.

Keys and key retainers, having substantial metallic components, are normally relatively heavy for their weight. Furthermore, they normally are as smooth surfaced as possible in order to present a pleasing appearance and in order not to chafe surrounding materials. Because of the relative weight, small size, and smoothness of their sides, a person holding the key retainer in a pocket is normally inhibited from partaking in strenuous physical activity, due to the propensity of the key retainer to bounce due to its inertia, slip out of the open pocket, and possibly become lost.

Consequently, where bouncing or other strenuous physical activity is to be undertaken, the key retainer is often removed from the pocket, which allows it to become easily misplaced and thus lost.

The problem is particularly large where the bounce is obtained in a vehicle such as in a snowmobile, boat, or short wheel base highway vehicle. Keys in the pocket of a rider of such a vehicle stand a fairly good chance of bouncing out of the pocket, and becoming lost unless tucked into a fold in the pocket. Furthermore, where a vehicle such as a snowmobile is stopped at a location where a snowmobile suit is not removed and where the snowmobile ignition key is manipulated using heavy mitts, the snowmobile key easily slips from the fingers of the mitts, and can become lost in the snow. Deposition in a pocket by a pair of mitts can cause misplacement and, again, loss.

I have invented a key retainer which substantially reduces the risk of loss while being retained in the pocket of a rider of a bouncing vehicle, or by a person taking part in strenuous physical activity. Furthermore, the key retainer reduces the risk of loss upon manipulation by a gloved hand.

The invention is a key retainer comprising a block of resilient compressible foam material, and means for holding the key, fixed to the foam material. The key retainer is used by compressing the foam with bare or gloved hand, inserting it with the key in the pocket and removing the hand. The foam material expands, filling a substantial portion of the pocket, which imparts substantial friction to the key retainer. Bouncing or strenuous physical activity will substantially not dislodge the key retainer.

The invention is therefore particularly useful for the insertion in the pocket of a snowmobile suit or the like, and while the pocket will be visibly expanded, this is believed to be a small price to pay for the security and peace of mind obtained by knowledge that the attached key is secure and safe.

Since the foam material is light, but its open surface cells have a substantial friction factor against other materials, it has been found that the inertia imparted by the metallic key attached thereto is insufficient to dislodge the key retainer.

A better understanding of the invention will be obtained by reference to the description below, and the following drawings, in which.

Figure 1:
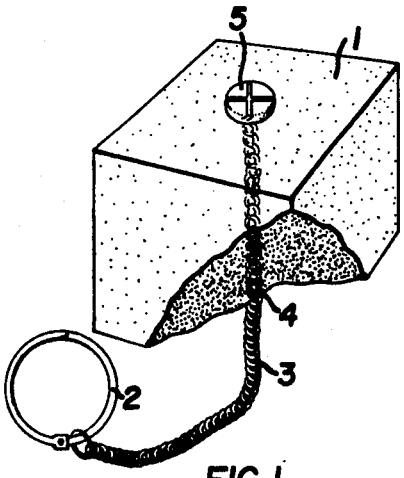
FIG. 1 is a perspective view of the key retainer with a portion cut away.

Turning now to FIG. 1, the preferred embodiment of the key retainer is shown, comprised of a block of resilient compressible foam material 1. Means for holding a key is shown, which is comprised of a key ring 2 which is fastened by conventional means to a chain 3. The chain is passed through a hole in the block of foam material; the chain is shown entering the hole at an entrance 4, and it extends completely through to the opposite face of the block of foam material. At the opposite face it is held by a button 5 which is of a diameter substantially larger than the diameter of the hole. The diameter of the hole should be considerably narrower than the width of the chain 3, whereby the resilience of the block of foam material will cause compression of the chain within the hole, holding it in place.

Preferably the block of foam material is a cube having dimensions of about 2½ to 3 inches on a side. Of course the size of foam material need not be limited to this range nor shape, as will be discussed further below.

Figure 2:
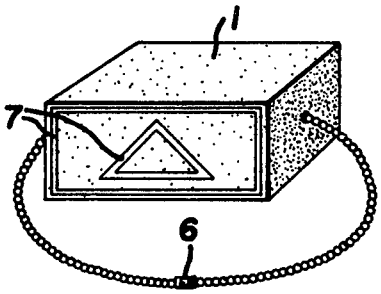
FIG. 2 is a perspective view of a second embodiment of the inventive key retainer.

FIG. 2 shows a second embodiment of the invention. A block of foam material 1 has a hole extending therethrough from one face to the other. A chain 3 formed into a loop is passed through the block of foam material, connected by fastener 6. Keys are retained on the chain 3.

The preferred material for the block of foam material is polyurethane foam of open cell type. Such foam is available in slabs from the Monsanto Corporation.

The block of foam material is preferably imprinted with a design which can be used for identification or advertising purposes.

FIG. 2 shows a design 7 which has been imprinted on one surface of the block of material.

Since in use the key retainer will be subjected to substantial abrasion and flexing, it is preferred that an imprinting technique and ink be used which imparts a design which is non-flaking, stable, easy to control, stable in water, and will be retained in the presence of abrasion.

The material can be imprinted and will retain the requirements noted above by the use of sublistatic ink applied through a transfer process. A design in mirror image is imprinted, as by silk screening on the surface of a transfer paper. The transfer paper is then brought into contact with a surface of the block of foam material, and is heated, as with an iron. The sublistatic ink transfers to the surface of the foam material, and in fact penetrates the cells to a significant depth.

Due to the penetration, typically ⅛ inch, surface wear has little effect on the visibility of the design. A sublistatic ink suitable for this process is obtainable under the Trade Mark ±Marler Tex" from Hunter-Penrose Limited, Bridge Road, Kingswood, Bristol, England.

Figure 3:
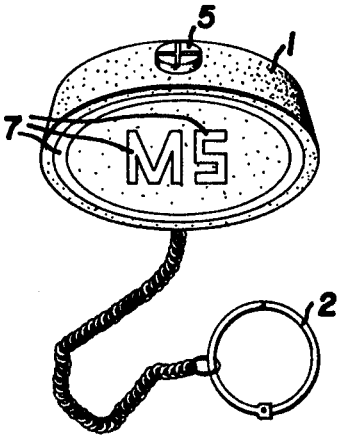
FIG. 3 is a second form of the first embodiment of the inventive key retainer.

FIG. 3 depicts a form of the invention by which the block is shaped to a predetermined recognizable shape other than a cube. The block 1 can be formed into the outline of a trade mark design or logo, and a design 7 can also be imprinted thereon to produce the full trade mark. The chain 3, key ring 2, and button 5 in this Figure are fixed to the block of foam material 1 in the same manner as that described with reference to FIG. 1.

Figure 4:
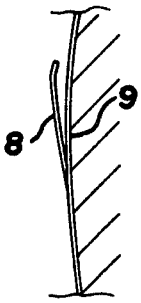
FIG. 4 is a side sectional view of an empty pocket in an article of clothing.
Figure 5:
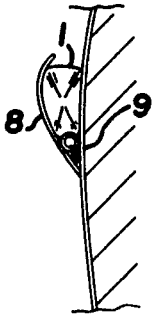
FIG. 5 is a side sectional view of the same pocket containing the inventive key retainer.

Reference is now made to FIGS. 4 and 5 in explanation of use of the invention. A pocket 8 is shown attached to the material 9 of an article of clothing. The pocket 8 is shown in FIG. 4 as substantially closed and lying approximately parallel to the material of the article of clothing 9.

To operate the invention, the block of foam material 1 is grasped in the hand, and compressed to a considerably smaller volume, preferably one-third or less than one-third of the expanded volume of the block. The entire compressed key retainer as well as the chain and key ring are then deposited in the pocket 8 of the article of clothing. The hand is removed, and the block of material 1 expands, substantially filling the pocket.

It has been found that the pressure of the block of material 1 against the pocket 8 and material of the article of clothing 9 provides so much frictional force that it is retained securely even during bouncing, turning over of the wearer of the clothing, etc.

Furthermore, the open cell form of polyurethane foam preferred for this invention exhibits unusually high friction against even relatively smooth surfaces, when there is some compression force against the foam material. This further enhances the force of retention of the key retainer within the user's pocket. The compression force is provided by the tension exhibited by the pocket in refusing to expand further than its own small elasticity would allow, under the expansion force of the compressed block of foam material.

Accordingly, substantial security of retention of the key retainer within a pocket is offorded.

It has also been found that the use of polyurethane foam has a substantial advantage when used to carry the key of speed boats and other water vehicles. Should the ignition key of such water vehicle fall overboard, as sometimes is the case, the polyurethane foam, having a density normally substantially less than water, acts as a float for the key. The key therefore does not sink to the bottom of the body of water as would otherwise be the case. Use as a float is obtained even with open cell type polyurethane foam.

Furthermore, by the use of the sublistatic ink noted above, the surfaces of the block of foam material can be coloured highly visibly, for instance in red. However, the normal unpainted white colour of polyurethane foam is also highly distinctive. Nevertheless the appearance of the key retainer is enhanced if imprinted with a design.

Furthermore, for use with boats, the key retainer can also be used to retard loss as described earlier. Users of speed boats and other water vehicles are often dressed in bathing suits which have insecure pockets for the retention of keys. The present key retainer can be compressed and squeezed inside the tie ring or elastic rim of a bathing suit, and will expand to exert force against both the bathing suit and the wearer's body. The friction factor noted earlier, along with the forces noted above provide substantial security of retention of the attached key.

While open cell polyurethane foam is the preferred material for this invention, persons skilled in the art understanding this specification may now conceive of other materials and other forms of the invention which are similar to the present. All are considered within the scope of the invention as defined in the appended claims.

The embodiments of the invention in which an exclusive property or privilege is claimed are defined as follows:

1. A key retainer comprising a block of resilient compressible foam material, and means for holding said key comprised of a chain passing through a hole completely through the block of material, fixed at one end to a button having a diameter substantially wider than the hole, the button being located directly against the surface of the block of material, the hole having diameter smaller than the width of the chain whereby the sides of the hole retain the chain in position by friction.

2. A key retainer as defined in claim 1 further including a key ring attached to the other end of the chain.

3. A key retainer as defined in claim 1 in which the block of material is comprised of polyurethane foam.

4. A key retainer comprising a block of resilient compressible foam material, and means for holding said key passing through a hole completely through the block of material, the block of material being comprised of unsealed polyurethane foam cut in a predetermined shape for easy visual identification, at least one surface thereof being imprinted with a design with sublistatic ink.

5. A key retainer as defined in claim 1 in which the block of material is comprised of polyurethane foam cut in the shape of a cube, surfaces of the cube being imprinted with a design with sublistatic ink.

6. A key retainer as defined in claim 4, the block of material being comprised of polyurethane foam of uncompressed size such as to expand the pocket of an article of clothing, and being compressible by hand to a size no greater than one-third its uncompressed size.

7. A key retainer as defined in claim 1 in which the block of material is comprised of polyurethane foam cut in predetermined shape for easy visual identification, the block of material being of foam of uncompressed size such as to expand the pocket of an article of clothing, and being compressible by hand to no greater than one-third its uncompressed size, at least one surface thereof being imprinted with a design with sublistatic ink.

* * * * *